United States Patent [19]

Mollon

[11] Patent Number: 4,644,171

[45] Date of Patent: Feb. 17, 1987

[54] NEUTRON ABSORBING PANEL

[75] Inventor: Leslie Mollon, Southfield, Mich.

[73] Assignee: AAR Corporation, Elk Grove Village, Ill.

[21] Appl. No.: 720,498

[22] Filed: Apr. 1, 1985

[51] Int. Cl.[4] ..... G21C 11/06; G21F 1/12; B22F 3/18; B22F 7/02

[52] U.S. Cl. ..... 250/518.1; 250/517.1; 419/50; 428/627; 376/287; 376/288

[58] Field of Search ..... 250/518.1, 517.1, 515.1; 419/50; 428/627; 376/287, 288

[56] References Cited

U.S. PATENT DOCUMENTS

| | | | |
|---|---|---|---|
| 2,727,996 | 12/1955 | Rockwell et al. | 250/517.1 |
| 4,006,362 | 2/1977 | Mollon et al. | 250/518.1 |
| 4,027,377 | 6/1977 | Roszler | 419/50 |

*Primary Examiner*—Bruce C. Anderson

*Assistant Examiner*—Jack I. Berman

*Attorney, Agent, or Firm*—Barnes, Kisselle, Raisch, Choate, Whittemore & Hulbert

[57] ABSTRACT

A panel of neutron shielding material comprises outer sheathing layers of aluminum having therebetween alternate thin layers or plies of aluminum and metallurgically bonded uniform mixtures of aluminum particles and particles of a neutron absorbing material, preferably boron carbide ($B_4C$) in which the layers have their major dimensions extending substantially parallel to the outer aluminum layers. In a modified construction, the alternate layers or plies may extend perpendicular to the outer aluminum layers or plies. The assembly is hot rolled to a final thickness, usually about one quarter or one eighth inch, metallurgically bonding the aluminum sheets, strips, and/or particles and the aluminum and boron carbide particles into a continuous mass.

19 Claims, 5 Drawing Figures

FIG. 1
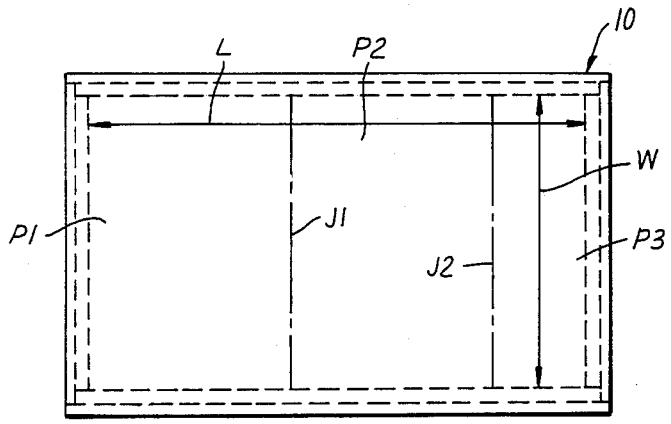
FIG. 3
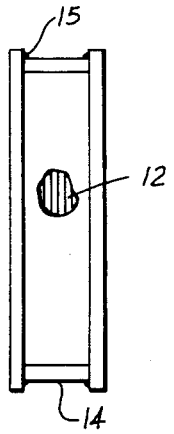
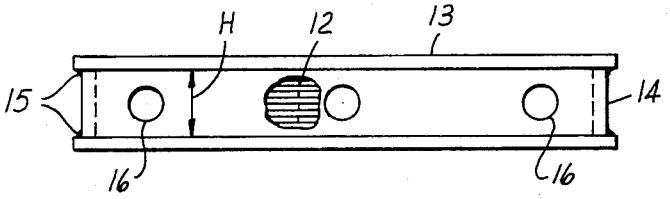
FIG. 2
FIG. 4
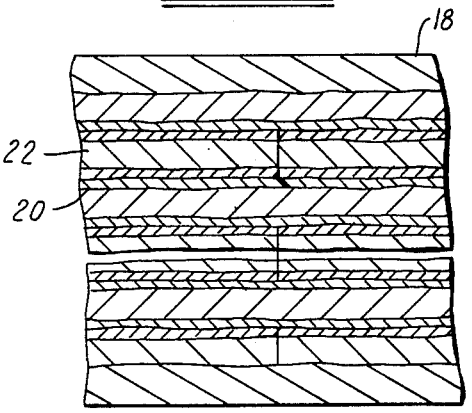
FIG. 5
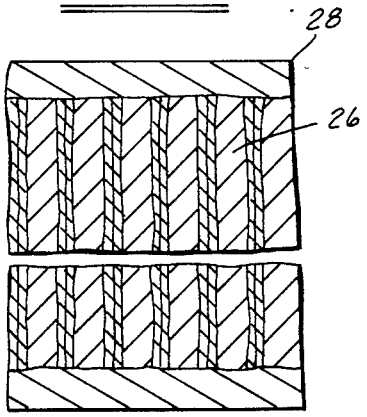

NEUTRON ABSORBING PANEL

STATE OF THE ART

Panels which incorporate neutron absorbing material, such as boron carbide ($B_4C$) and aluminum having outer plies of aluminum are known.

U.S. Pat. No. 2,727,996, discloses mixing $B_4C$ into molten aluminum to produce the core material, and metal sheathing such as aluminum is applied and the assembly rolled to desired thickness.

U.S. Pat. No. 4,027,377, discloses incorporating a uniform mixture of aluminum and $B_4C$ particles in a closed aluminum box, heating the box and contents, and hot rolling to the desired thickness, usually about half or quarter inch.

BRIEF SUMMARY

The present invention is an improvement over assignee's prior U.S. Pat. No. 4,027,377, referred to above.

As before an aluminum box having top and bottom plates welded to side and end strips is provided, openings being left for escape of air during rolling. The plates and strips have initial thickness of about 0.50" and the box may be fabricated by welding to have an initial thickness of 3–4", a width of about 12–15", and a length of about 20–23".

Before welding the cover on the box, it is filled with a multiplicity of separate pieces of the neutron absorbing sheet material as produced in accordance with the disclosure of assignee's prior U.S. Pat. No. 4,027,377. This material a thickness of about 0.075 to 0.265 and the upper and lower sheets of aluminum are continuous and each has a thickness of about 0.010 or 0.060, depending on the thickness to which the sheet was rolled.

The pieces of sheeting material are cut to fit within the box, and have dimensions lengthwise of the box, which for example, may be 40% or 20% of the interior length of the box. This permits one layer to be made up, for example, of one piece at left hand end of the box, as seen in FIG. 1, and its right hand edge will occupy the position indicated by dot and dash line J1. The second piece will have its edges occupying lines J1 and J2. The third piece, the narrowest of the three, will be at the right hand edge of the box, and its left hand edge will occupy the position indicated by line J2. The next layer will have its narrow piece at the left end of the box, so that the abutting edges of each layer are spaced from the abutting edges of adjacent layers.

This arrangement is to prevent inadvertent spaces between adjacent edges of pieces of one layer from registering with adjacent edges of pieces of adjacent layers. Any pattern of placement to produce this result is suitable, and the particular arrangement is described only by way of example. It may be necessary to also add a blend of aluminum and boron carbide powder where excessive gaps exist either between adjacent pieces or along the outer edges at the inside of the welded box thereby preventing the possibility of windows for the penetration of neutrons through the panel.

The cut pieces are selected to provide a predetermined quantity of neutron absorbing material.

The box is provided with end or edge openings to permit escape of air, and are heated and rolled while hot as described in prior U.S. Pat. No. 4,027,377.

In the hot rolling, the adjacent aluminum sheets are metallurgically bonded, and of course the previously amalgamated mixtures of aluminum and neutron absorbing particles remain in bonded condition.

The presence of thin continuous plies or layers of aluminum in the space between outer cover sheets adds to the strength of the panels and increases the ability to withstand bending of the panels without rupture of the internal neutron absorbing material.

Similar results may be obtained by filling the box with strips which are placed vertically within the box, perpendicular to the top and bottom plates.

BRIEF DESCRIPTION OF THE DRAWINGS

FIG. 1 is a plan view of a box prior to rolling.

FIG. 2 is a side view of the box.

FIG. 3 is an end view of the box.

FIG. 4 is a greatly enlarged sectional view of the completed panel.

FIG. 5 is a view similar to FIG. 4, with the strips arranged with their flat sides vertical.

COMPLETE DESCRIPTION

Referring now to the drawings, there is illustrated in FIGS. 1–3 the box 10 into which the special neutron absorbing material indicated at 12 is placed. The box in general is similar to that shown in prior U.S. Pat. No. 4,027,377, and the structure shown in these figures differs essentially only in the nature of the neutron absorbing material.

For completeness, a typical example will be described with representative dimensions. The box 10 is formed of 0.50" aluminum plates 13 and strips 14 assembled to provide an interior whose long dimension indicated at L is about 20", whose width dimension indicated at W is about 12", and whose height dimension indicated at H is about 2.4". As shown, the strips forming the sides and ends of the box are inset approximately 0.25" from the side and end edge surfaces of the top and bottom plates to provide space for the welds indicated at 15. The ends of the box are provided with openings 16 to permit the escape of entrapped air during the rolling operation.

The box is filled as completely as possible as indicated at 12 with a multiplicity of pieces of the shielding material produced by the method described in U.S. Pat. No. 4,027,377. This shielding material is in the form of sheets usually having uniform standard thicknesses of 0.125 or 0.250". These sheets each have a uniform core of neutron absorbing material comprised of particles of $B_4C$ and aluminum which have been metallurgically bonded together and to the inner surfaces of the outer cover sheets. These pieces are stacked together in the box, in such a way that no joints between laterally adjacent pieces in adjacent rows are directly over one another.

Preferably, it is desirable to avoid having as few as possible of such joints in alignment.

After the box is filled and the multiple layers of separate pieces compacted, the top cover is placed and welded as shown.

Thereafter, the procedure outlined in prior U.S. Pat. No. 4,027,377 is followed to produce neutron absorbing panels of specified thickness usually 0.125 or 0.250". The procedure comprises heating to bring the ingot metal to 800° to 850° F., and thereafter cross-rolling to the specified thickness.

The resulting panel, as seen greatly enlarged in FIG. 4, has cover sheets or sheathing 18 of aluminum having a thickness of about 0.020 or 0.040", depending on the thickness to which the material is rolled. Instead of a uniform core of welded together particles of aluminum and $B_4C$ as disclosed in U.S. Pat. No. 4,027,377 the core includes substantially continuous aluminum strata 20 separated by layers 22 of welded together $B_4C$ and aluminum particles. This core material represents an improvement in the homogeneous core material disclosed in U.S. Pat. No. 4,027,377, in that the multiple substantially continuous strata of aluminum, to which the adjacent particulate material is metallurgically bonded, reinforces the core and tends to prevent or minimize fractures within the core material as a consequence of bending in applying the panels to structure to be shielded.

The aluminum strata referred to are very thin, having a thickness reduced from about 0.040 or 0.080 formed by two adjacent cover sheets or sheathing by a factor of twelve to twenty four. They are somewhat irregular, as suggested in FIG. 4, but for the most part are thin and generally continuous strata. Thus, the aluminum strata may be as thin as 0.001–0.002". It is important to avoid arranging the pieces of neutron absorbing material in such a way that they might leave windows for penetration of neutrons through the panel.

It will be appreciated that the cut pieces of neutron absorbing sheet material form a multiplicity of layers as they are placed in the box.

Referring again to FIG. 1, a single layer is shown constituted by three pieces designated P1, P2 and P3. Pieces P1 and P2 have straight abutting edges defining a seam or joint at the line J1. Pieces P2 and P3 have straight abutting edges defining a seam or joint at the line J2.

In order to avoid the possibility of neutron penetration as mentioned above, the next adjacent layer may be constituted by pieces dimensioned to space the seams or joints laterally from lines J1 and J2, and to avoid so far as practicable the coincidence of seams or joints in the several layers.

In the arrangement as indicated at 12, where the flat pieces of sheet material are parallel to the top and bottom plates, there will be a multiplicity of layers of pieces, as for example about sixteen and usually at least ten. This quantity will vary for each ingot design depending on the specific type of pieces used at 12 and the specific requirements for the new material. If the feedstock material is at 12, is low in $B_4C$ content more will be required and conversely if the $B_4C$ is high less will be required.

Where cut pieces of panels as produced in accordance with the prior patent have one or more edges spaced appreciably from the adjacent piece, or from a side wall of the box, this space may be filled with a mixture of $B_4C$ and aluminum particles, prior to initial rolling.

Referring now to FIG. 5, there is illustrated a modification in which the box is filled with a multiplicity of narrow strips 26 of the neutron absorbing material produced in accordance with prior U.S. Pat. No. 4,027,377. The strips in this case are placed as indicated at 26 in FIG. 5, with their side edges abutting cover plates 13 which form the outer sheathing 28 after hot rolling.

While the neutron absorbing material disclosed herein is an improvement over the material disclosed in prior U.S. Pat. No. 4,027,377, it also has the advantage that scrap or imperfect sheet material made by the method disclosed in U.S. Pat. No. 4,027,377 may be cut up to provide the aluminum sheathed pieces of metallurgically bonded aluminum and $B_4C$ particles.

It will be understood that where aluminum sheets, strips, or particles are referred to, aluminum alloys which exhibit the essential physical properties of aluminum are to be included. The panels as disclosed herein represent a definite improvement over those as disclosed in the prior patent. The improved panels may be cold bent to a small radius, as for example 2.5 inches about any axis irrespective of the direction of reduction rolling.

This also appears to be a significant increase in neutron attenuation.

I claim:

1. A neutron absorbing panel comprising thin continuous external aluminum sheathing at opposite sides, and a core comprising a multiplicity of alternate plies of substantially continuous, very thin strata of aluminum and neutron absorbing material, in which the neutron absorbing material is metallurgically bonded to the aluminum strata and to the aluminum sheathing.

2. A panel as defined in claim 1, in which the aluminum strata have a thickness as small as 0.001".

3. A panel as defined in claim 1, in which the aluminum strata extend in parallelism with the external sheathing.

4. A panel as defined in claim 3, in which the aluminum strata extend generally prependicular to the external sheathing.

5. A panel as defined in claim 1, in which neutron absorbing material is a substantially uniform mixture of metallurgically bonded together particles of aluminum and boron carbide.

6. The method of making neutron absorbing panels which comprises forming a rectangular metal box by welding together adjacent edges of a rectangular bottom plate and rectangular side and end strips completely filling the box with a multiplicity of pieces of neutron absorbing sheet material, in which said sheet material comprises a neutron absorbing core with metal sheathing metallurgically bonded to opposite sides thereof, placing said pieces in said box with metal sheathed sides thereof in contact, welding a metal top cover plate to the top edges of said side and end strips heating the filled box to a temperature at which the metal sheathing of said pieces may be metallurgically bonded together under pressure, and rolling the heated box to reduce its thickness to a small fraction of the original thickness of the box to metallurgically bond the confronting metal sheathed surfaces of said pieces together and the inner surfaces of the top and bottom plates to the metal sheathed surfaces of the pieces adjacent thereto.

7. The method as defined in claim 6, in which said box is formed of aluminum plates and strips.

8. The method as defined in claim 6, in which metal sheathing said pieces is aluminum.

9. The method as defined in claim 7, in which metal sheathing said pieces is aluminum.

10. The method as defined in claim 6, in which said neutron absorbing core comprises a uniform mixture of metallurgically bonded particles of aluminum and neutron absorbing particles.

11. The method as defined in claim 10, in which said neutron absorbing particles are boron carbide ($B_4C$).

12. The method as defined in claim 6, in which the pieces of neutron absorbing sheet material are cut to fit within said box, in which the cut pieces are parallel to said cover plates, and in which the cut pieces are dimensioned such that a plurality of pieces are required to constitute a single layer.

13. The method as defined in claim 12, which comprises filling any substantial spacing between the edges of laterally adjacent pieces or with the sides of the box with a mixture of particles of $B_4C$ and aluminum prior to rolling.

14. The method as defined in claim 12, in which adjacent adges of the cut pieces in a single layer constitute a seam, and in which the seams of the several layers are spaced laterally from each other.

15. The method as defined in claim 13, in which adjacent edges of the cut pieces in a single layer constitute a seam, and in which no seams of adjacent layers coincide.

16. The method as defined in claim 6, in which a minimum of ten layers of pieces are provided in each box.

17. The method as defined in claim 6, in which the box is reduced in rolling from at least 3" to approximately 0.125".

18. The method as defined in claim 6, which comprises cutting the pieces of neutron absorbing sheet material into strips having a width equal to the height of the cavity within said box, and filling the box with strips extending between the top and bottom plates and with their sheathed sides in contact.

19. The method as defined in claim 6, in which the box is reduced in rolling from at least 3" to approximately 0.250".

* * * * *